United States Patent [19]

Roussy

[11] Patent Number: 5,027,908

[45] Date of Patent: Jul. 2, 1991

[54] BEARING APPARATUS AND METHOD FOR PRELOADING BEARINGS FOR ROTARY-VIBRATORY DRILLS

[76] Inventor: Raymond J. Roussy, 10241 - 148th Street, Surrey, B.C., Canada, V3R 6S4

[21] Appl. No.: 415,552

[22] Filed: Oct. 2, 1989

[51] Int. Cl.[5] ..... E02D 7/18

[52] U.S. Cl. ..... 173/49; 172/40; 384/91; 175/55

[58] Field of Search ..... 173/49; 172/40; 384/91; 175/55

[56] References Cited

U.S. PATENT DOCUMENTS 2,950,901 8/1960 Mathewson, Jr. ..... 173/49

*Primary Examiner*—Douglas D. Watts
*Assistant Examiner*—Willmon Fridie, Jr.
*Attorney, Agent, or Firm*—Shlesinger Arkwright Garvey

[57] ABSTRACT

A vibratory apparatus includes an outer member with a central opening. An inner member is within the opening of the outer member. There are two sets of bearings between the outer member and the inner member for permitting relative rotation therebetween about an axis. The two sets of bearings are spaced apart along the axis, each having an inner race and an outer race. The inner races are slidably mounted on the inner member. A portion of the outer member is disposed between the outer races so as to hold the outer races a first distance apart and so the inner races are held a second distance apart when the inner member and outer member are unloaded. Each of the sets of bearings transfers from the inner member to the outer member those forces acting along the axis which are directed towards the other set of bearings only. There is a spacer disposed between the inner races. A nut connected to the inner member biases the inner races towards each other along the axis with a force which has a first component transmitted from the inner member to the portion of the outer member by the sets of bearings and a second component which is borne by the spacer.

18 Claims, 6 Drawing Sheets

BEARING APPARATUS AND METHOD FOR PRELOADING BEARINGS FOR ROTARY-VIBRATORY DRILLS

BACKGROUND OF THE INVENTION

This invention relates to bearings used in combination rotary-vibratory pile drivers or drills, in particular sonic drills or pile drivers, and to a method for preloading such bearings.

Rotary-vibratory drills employ a vibratory force superimposed upon a rotary action to accomplish the drilling operation. Such drills are mainly advantageous for increasing drilling speed when drilling overburden and rock in geological drilling operations, for example during placer exploration.

Sonic drills are rotary-vibratory drills where the vibration frequency is in the sonic range, typically between 50 and 120 Hertz. The frequency range is chosen to achieve high drilling rates and also to allow the vibrations to coincide with the resonant frequency of the drill string or steel pile. If the machine does not operate at resonance, as more and more weight of drill pipe is added, the amplitude of the tip of the drill bit is reduced to such a point that little power is transmitted and drilling does not proceed further.

Until the advent of sonic drills, the only methods available to sample gold placer properties have been cable tool percussion drilling (also known churn drilling or Keystone drilling), continuous sample recovery with air rotary and surface bulk sampling. All of these methods suffer disadvantages which have been addressed by the development of sonic drills. However there are other applications for sonic drilling such as installation of concrete piles, water well drilling, rock drilling for blast holes and rock coring.

However, problems have been encountered in finding a bearing assembly for rotary-vibratory drills in general, and sonic drills in particular, which is capable of transmitting the vibratory forces encountered, while accommodating the rotary motion.

One type of bearing assembly used in the past employs a stem-like inner member surrounded by an annular outer member. Angular contact ball bearings are fitted between the two members. A vibratory device is placed on either the outer member or the inner member while the other member rotates. The drill string is connected to the rotating member. It is essential to stop play developing in the bearings during drilling operations. The inner races of the sets of bearings are typically held between a shoulder at one end the inner member and a nut at the other end of the inner member. The outer races of the bearings are held apart by an intervening portion of the outer member. Preloading is accomplished by forcing the bearings towards each other and tightening the nut so as to tension the inner member and likewise compress the portion of the outer member between the outer races. This preloading places a considerable force across the bearings even before vibratory forces are encountered. Thus the total force on the bearings is the initial preloading plus the oscillating vibratory force. The maximum forces encountered are relatively high and lead to premature failure of the bearings.

OBJECTS OF THE INVENTION

It is therefore an object of the invention to provide a bearing assembly for use on rotary-vibratory drills, in particular sonic drills, which eliminates radial and axial play in the bearings while, and at the same time reduces the maximum loading upon the bearings so that bearing life is enhanced.

It is furthermore an object of the invention to provide a bearing assembly which is rugged and simple in structure and which is designed to withstand the rigorous conditions encountered in all types of geological drilling operations and pile driving.

SUMMARY OF THE INVENTION

Accordingly, the invention provides a bearing assembly having an outer member with a central opening and an inner member within the opening of the outer member. A first bearing means and a second bearing means are between the outer member and the inner member for permitting relative rotation between the members about an axis. The bearing means are spaced-apart along the axis. Each of the bearing means has an inner race and an outer race. A portion of the outer member is disposed between the outer races so as to hold the outer races a first distance apart and thereby hold the inner races a second distance apart when the inner member and the outer member are unstressed. The inner races are slidably mounted on the inner member for movement towards each other relative to the inner member. Each of the bearing means has means for transferring forces along the axis from the inner member to the outer member which are directed towards the other bearing means only. There is spacing means disposed between the inner races for spacing the inner races.

There is means operatively connected to the inner member for biasing the inner races towards each other along the axis with a force sufficient to compress the spacing means. The force has a first component which is transmitted from the inner member to the portion of the outer member by the bearing means and a second component which is borne by the spacing means.

The invention also provides a method of preloading bearing assemblies for combination rotary and vibratory drills. The method comprises the steps of positioning a spacer between inner races of the sets of bearings, the spacer having a dimension extending between the inner races which is less than the distance that the inner races are held apart when the assembly is unloaded. The assembly is preloaded by drawing the sets of bearings towards each other while tensioning the inner member and compressing the portion of the outer member and the spacer until radial play and axial play in the bearings is eliminated and the spacer is in compression between the inner races. The preloading should be sufficient so that the inner member remains in tension during use of the assembly with combination rotary and vibratory drills.

BRIEF DESCRIPTION OF THE DRAWINGS In the drawings.

DESCRIPTION OF THE PREFERRED EMBODIMENTS

Figure 1:
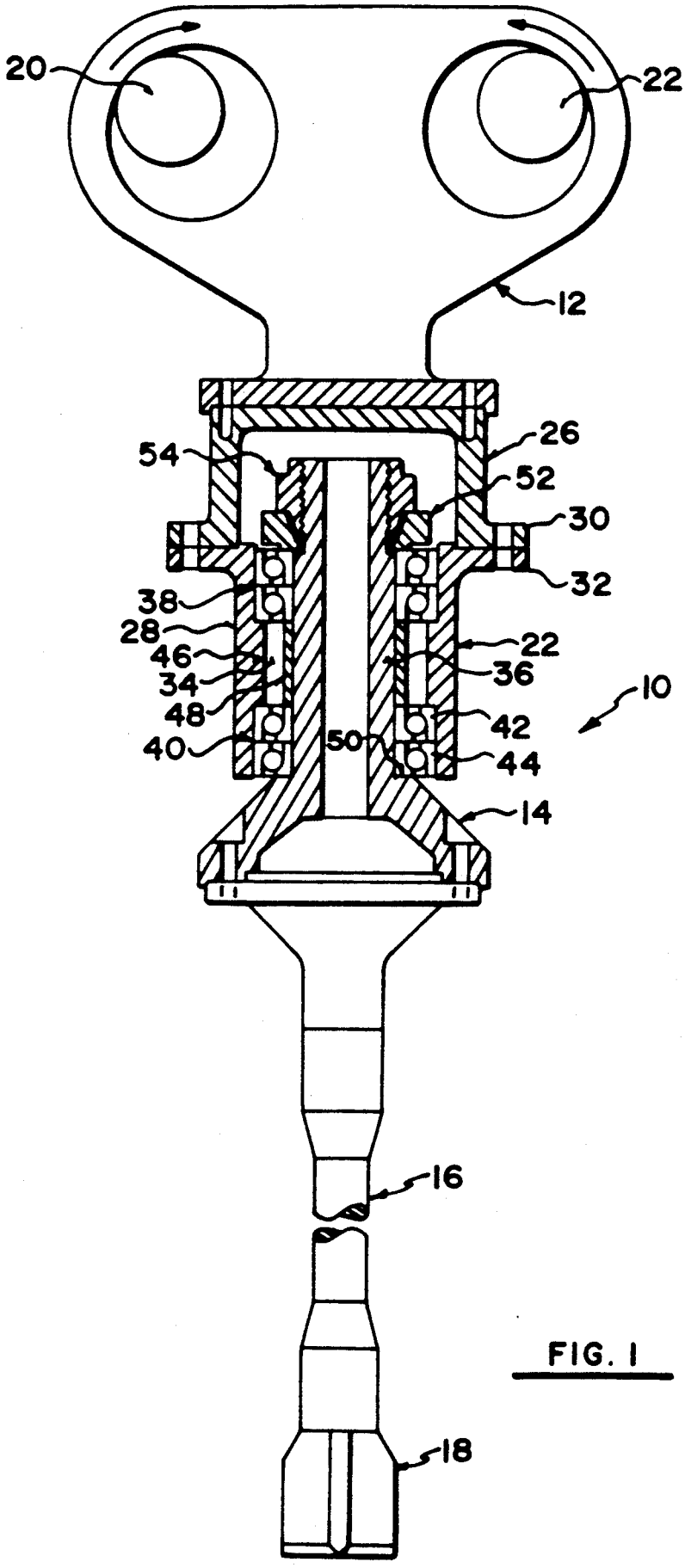
FIG. 1 is a simplified side elevation of a vibrator with attached combination rotary and vibratory drill according to a first embodiment of the invention with the bearing assembly thereof shown in section.

Referring firstly to FIG. 1, this shows, in simplified form, a combination rotary and vibratory drill assembly 10. Such drills employ vibration from a vibrator 12 and rotary motion, in this case imparted to inner member 14, to drive a drill string 16 equipped with a drill bit 18 into a geological formation, such as earth or rock. The drill assembly can also be used for other purposes such as driving piles.

The vibrator 12 in this instance is equipped with two eccentric devices 20 and 22 which are rotated by, for example, an hydraulic motor (not shown). The vibrator 12 also conventionally includes an air spring or other isolation means to isolate the vibrations from the main structure (neither shown). The vibration rate of the drill depends upon the rotation rate of the eccentric devices and, as specified above, this is typically in the range of 50–120 Hertz for sonic drills. The frequency of the vibration is numerically the same as the rotational speed of eccentrics 20 and 22 which are identical, but rotate in opposite rotational directions. The eccentrics are positioned relative to their axes of rotation such that they coincide at the top and bottom of their strokes, but are on opposite sides when midway between the top and bottom. In this way, the effect of the eccentrics is additive in the vertical direction, but subtractive in the horizontal direction. Thus the net vibrating forces are vertical, while the horizontal components cancel out.

The oscillating force produced in the vertical direction by the vibrator 12 is applied to an outer member 24 having an upper portion 26 and a lower portion 28. The upper portion is in the shape of an inverted bowl and is bolted to the lower portion at their respective flanges 30 and 32.

The lower portion 28 is generally sleeve-shaped with a cylindrical, hollow interior 34.

Inner member 14 has a hollow, shaft-like upper portion 36 rotatably received within the hollow interior of the outer member by means of two sets of bearings 38 and 40. The hollow construction of the inner member makes it lighter and more elastic as well as allowing the passage of fluids through the assembly if desired. The two sets of bearings are spaced apart and each comprises two adjacent angular contact ball bearings, for example bearings 42 and 44 of the lower set of bearings 40. In alternative embodiments, there may be only two spaced-apart bearings used. In either case, commercially available angular contact ball bearings are suitable. However, these are usually supplied with a retainer cage to separate the balls and this may not withstand the forces encountered in a rotary/vibratory drill. Such cages can be removed by cooling the inner race with liquid nitrogen and heating the outer race to disassemble the bearing. The cage is then removed and one or more extra balls added to fill the space taken up by the cage. The capacity of the bearing is increased by adding the one or more balls. Alternatively newer type polyamid cages can withstand the vibration and needn't be removed.

A portion 46 of the outer member 24 has thicker walls and extends radially inwards so it is disposed between the outer races of the two sets of bearings, holding them apart. A sleeve-like spacer 48 is disposed between the inner races of the two sets of bearings and, with the inner races themselves, is slidably received on upper portion 36 of the inner member 14. The inner races of the bearings are held between a shoulder 50 at the lower end of portion 36 and an annular member 52 which is held against the top inner race of the set of bearings 38 by a nut 54 which is threadedly received on the top of portion 36.

As will be described in more detail for the alternative embodiment of FIG. 2 and 3, the nut 54 is tightened so that the inner races of the two sets of bearings 38 and 40 are forced towards each other. This places upper portion 36 of the inner member 14 in this embodiment in tension. A first component of the force thus applied to the inner races of the sets of bearings is transmitted across the ball races of the bearings to their outer races and ultimately to portion 46 of outer member 28 which is thereby placed in compression. A second component of this force is borne by the spacer 48, thereby also placing the spacer in compression and so reducing the maximum loading accommodated by the bearings themselves. The spacer 48 is slightly shorter in the vertical direction shown in FIG. 1 than the spacing between the inner races of the sets of bearings when the bearing assembly is unloaded. In other words, portion 46 of the outer member holds the inner races of the two sets of bearings a certain distance apart, but the height of the spacer is less than this distance prior to compression. Thus, when nut 54 is tightened, the outer races of the bearings are preloaded before the inner races simultaneously contact member 52 and the spacer. Thereafter, the increased load due to further tightening of the nut is borne chiefly by the spacer rather than across the bearings to portion 46 of the outer member. The length of the spacer, plus its cross-sectional area and material of construction are chosen such that the spacer carries the larger fractional component of the force when the nut is fully tightened.

Figure 2:
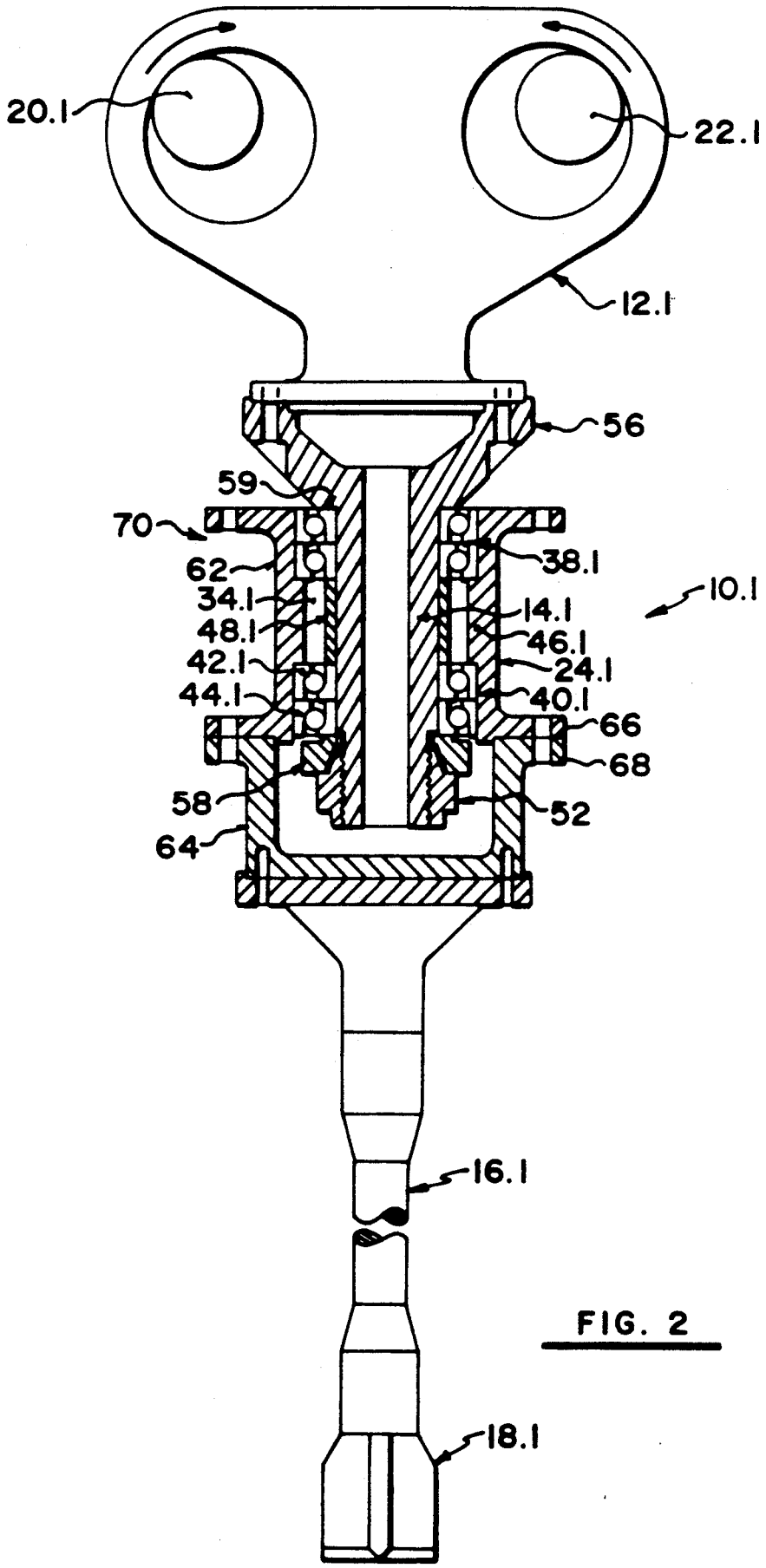
FIG. 2 is a view similar to FIG. 1 of a second embodiment of the invention.

Referring to FIG. 2, this shows a variation wherein like parts have like numbers with the additional numerical designation "0.1". These parts in common are therefore not described in detail. In the embodiment of FIG. 2, however, the vibrator 12.1 is mounted on top portion 56 of the inner member 14.1. The inner races of the two sets of bearings 38.1 and 40.1 are held between shoulder 59 of the upper portion of the inner member and annular member 58 supported by nut 60 which threadedly engages the lower end of inner member 14.1. The outer member 24.1 has a sleeve-like upper portion 62 which includes a portion 46.1 between the outer races of the sets of bearings. The upper portion 62 is bolted to lower portion 64 by means of bolts through their respective flanges 66 and 68. The top of the drill string is bolted to the bottom of lower portion 64.

Figure 3:
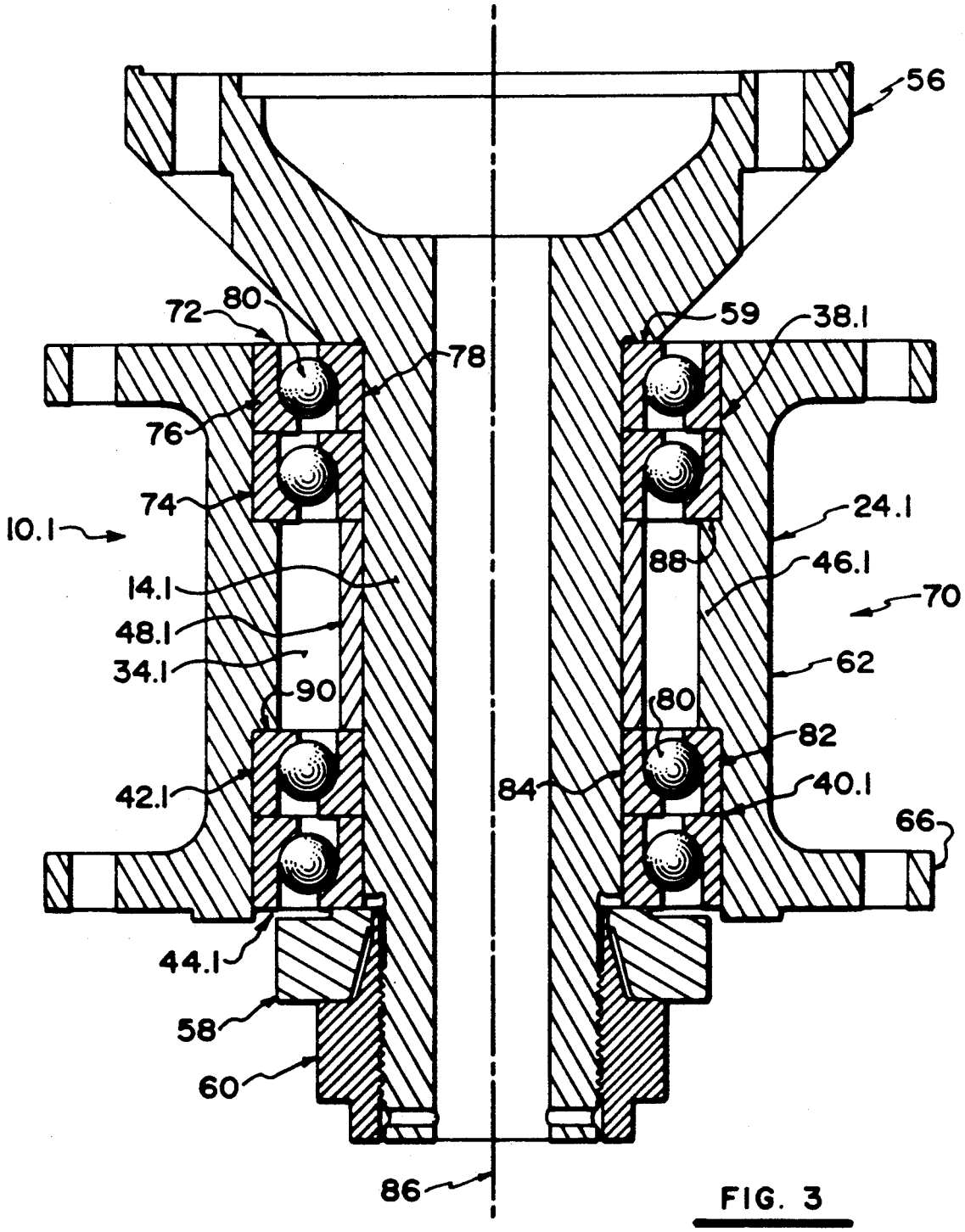
FIG. 3 is an enlarged sectional view of the bearing assembly from FIG. 2.

Bearing assembly 70 comprising the inner member, the two sets of bearings and the upper portion of the outer member is shown in better detail in FIG. 3. As described, the lower set of bearings 40.1 comprises two adjacent angular contact ball bearings 42.1 and 44.1. Likewise, the upper set of bearings 38.1 comprises two adjacent bearings 72 and 74. Each of the bearings of each set has an outer race and an inner race, for example outer race 76 of bearing 72 and inner race 78 of the same bearing. The races are annular in shape and receive a plurality of bearing balls 80 therebetween. The bearings are generally conventional and are referred to as "angular contact ball bearings" because the centers of the areas of contact of each of the bearing races are angled, in this case approximately 45°, from the vertical. It may be observed that the inner race 78 of bearing 72 overlies the balls 80, while the outer race 76 underlies the ball. Bearing 74 has the same configuration for the outer race and inner race. However, the lower set of bearings 40.1 has the bearing races arranged in the opposite direction. In other words, for example, outer race 82 of the bearing 42.1 overlies the balls 80, while inner race 84 underlies the balls. It may be appreciated that the bearings are therefore capable of transmitting vertical forces between the inner race and outer race, but only in one direction. In the case of bearings 72 and 74 of the upper set 38.1, forces can be transmitted in the vertical direction, that is parallel to the axis of rotation 86 of the drill, from the inner member 14.1 to the outer member 24.1 in the downwards direction only. Any attempt to transmit forces upwardly from member 14.1 to outer member 24.1 only causes the bearing races to separate away from the balls, thus the bearings are incapable of transmitting such forces.

In case of the lower set of bearings, they are capable of transmitting only upwards forces from the inner member to the outer member. Therefore it will be seen that each sets of bearings is capable of transmitting only those forces along axis 86 from the inner member to the outer member which are directed towards the other set of bearings. However, the bearings do transmit radial forces in addition to those along the axis.

Which vertical forces are transmitted from the inner member to the outer member through the angular contact ball bearings depends upon the particular configuration of the drill. In all cases, the above-described pre-loading forces due to tightening of the nut are transmitted to the outer member by the bearings. In the case of drill assembly 10.1 of FIG. 2 and 3, the upper set of bearings also transmits the downwards vibrational force from vibrator 12.1, which reaches its maximum when eccentrics 20.1 and 22.1 approach the bottom of their movement. This force is transmitted from the vibrator 12.1 to upper portion 56 of the inner member 14.1 and from the upper portion to the inner race 78 of bearing 72 and 74 via shoulder 59 of the upper portion. This force is transmitted across both of the bearings 72 and 74 from their inner portions to their outer portions and thereby to shoulder 88 of outer member 24.1. The forces thereafter are transmitted from flange 66 to lower portion 64 of the outer member and then to the drill string 16.1 as may be appreciated from FIG. 2.

At the opposite extreme of movement of the eccentrics 20.1 and 22.1, as they approach the top position of their rotation, an upwards force is applied in the vertical direction to inner member 14.1 This upwards force is transmitted from the bottom of the inner member across nut 60 and annular member 58 to the inner races of bearings 42.1 and 44.1 and across the balls of both bearings to their outer races and thereby to shoulder 90 and the outer member 24.1. Again, it will be observed that the forces being transmitted from the inner member to the outer member in the direction of the opposite set of bearings, in this instance towards set 38.1.

This arrangement, whereby each set of bearings transmits forces along axis 86 from the inner member to the outer member only in the direction towards the other set of bearings means that vibrational forces can only place portion 46.1 of the outer member in compression and place inner member 14.1 in tension.

However, slack can develop in the sets of bearings as they are cyclically loaded and unloaded. The development of axial play or radial play is undesirable and leads to premature failure of the bearings as the bearings are repeatedly loaded and unloaded. For this reason, it has been known to preload the bearings to remove the possibility of play developing during the drilling operation. In prior art assemblies this has been done by placing the inner member under constant tension by drawing the two sets of bearings together. For example, with reference of FIGS. 1 and 2, this is accomplished by placing the inner member under tension and. tightening nuts 54 or 60 so the bearings are biased towards each other between the nut and shoulders 50 or 59 respectively, thereby placing the inner member in tension. This operation may be accomplished either by tightening nuts 54 and 60 or, alternatively, by pressing the two sets of bearings towards each other, for example hydraulically, and then rotating the nut to take up the slack.

However, because the prior art lacked spacers 48 and 48.1, this operation placed a heavy preload entirely carried across the balls of the two sets of bearings. This preload, in combination with the oscillating vibration force, placed a high maximum loading on the bearings which, I have found, leads to the previously encountered short lifespan of these bearings. I have found that this problem can be overcome by using spacers 48 and 48.1. These are annular sleeves placed about the inner member between the inner races of the two sets of bearings.

Referring, for example, to FIG. 3, the tension created in inner member 14.1 as the sets of bearings are biased towards each other is partly countered by compression of spacer 48.1 as well as by forces transmitted by the bearings to portion 46.1 of the outer member. Thus, the compressional force transmitted to the outer member through bearing balls 80 is significantly less than in prior art bearing apparatuses where the sleeve was not used.

The proportion of the compressional force taken on by the spacer is dependent on a number of factors including its material, its cross-sectional area and its length in the vertical direction shown in FIG. 3. The material and the cross-section are generally chosen in advance for a specific embodiment of the invention, but the height can be varied readily so that the compressional forces in the spacer and in the outer member are within acceptable boundaries as will be explained below.

The upper and lower sets of bearings may be held against shoulders 88 and 90 of the outer member by tightening nut 60, but not enough to tension the inner member. In this condition, the outer member is unstressed and, in this embodiment, the distance between the inner races of the bearings is the distance between shoulders 88 and 90 of the outer member. However, the spacer 48.1 is slightly shorter than this distance so that tightening of nut 60 initially preloads the bearings by transferring forces across the bearings to compress portion 46.1 of the outer member. Upon further tightening, portion 46.1 is compressed enough so the inner races simultaneously contact the shoulder 59, spacer 48.1 and member 58. Thereafter, spacer 48.1 takes up additional loads without substantial additional forces being carried across the bearings to the outer member.

The height of portion 46.1 of the outer member, when unloaded, can be different than the distance between the inner races because one of the sets of races may be wider than the other. For example, the inner races may be wider and, in that case, the space between the inner races would be less than the distance between the outer races when the latter contact shoulders 88 and 90 of the outer member. In that case, the spacer may be even shorter relative to the distance between shoulders 88 and 90, but only slightly shorter than the distance between the inner races of the bearings when unloaded.

With the given material and cross-sectional area for the spacer, the height of the spacer is generally adjusted so that the spacer is always in compression and the inner member is always in tension during the drilling operation. This stops any play developing between the bearings and shoulder 59 of the inner member and nut 60. At all times the inner races of the sets of bearings 38.1 and 40.1 are held tightly between the spacer and the shoulder and the spacer and the member 58 respectively. At the same time, play within the bearings themselves, that is between the inner races, outer races and balls, is removed by pre-loading portion 46.1 in compression with a sufficiently compressive force to take up radial and axial play in the bearings themselves. As discussed above, this force must not be too large, however, or the loading within the bearings will be too high, thus leading to premature bearing failure.

A specific example of the invention is discussed below for illustrative purposes only. The exact dimensions and configuration depends upon various criteria such as the size of the unit desired and the working conditions.

Tension Member

Preload on inner member =60,000 lbs.
Cross-sectional area of tension member =4.82 in$^2$.
Stress =12,448 p.s.i.
Strain =0.0004149 in./in.
Length of inner member under tension =7 in.
Deflection of inner member =0.0029 in.
Spring constant of portion of inner member under tension =20,659,022 lb/in.

Compression Member

Load on compression members =50,000 lbs in spacer and 60,000 lbs in inner races of bearings.
Area of four inner races =2.08 in$^2$.
Stress in races =28,846 p.s.i.
Strain in races =0.0009615 in./in.
Length of inner races =3.776 in.
Deflection of races =0.0036 in.
Cross-sectional area of spacer =2.312 in$^2$.
Stress of spacer =21,626 p.s.i.
Strain in spacer =0.0007208 in./in.
Length of spacer =2.225 in.
Deflection of spacer =0.0016 in.
Total deflection =0.0052 in.
Spring constant of compression members =11,530,275 lb/in.

Figure 6:
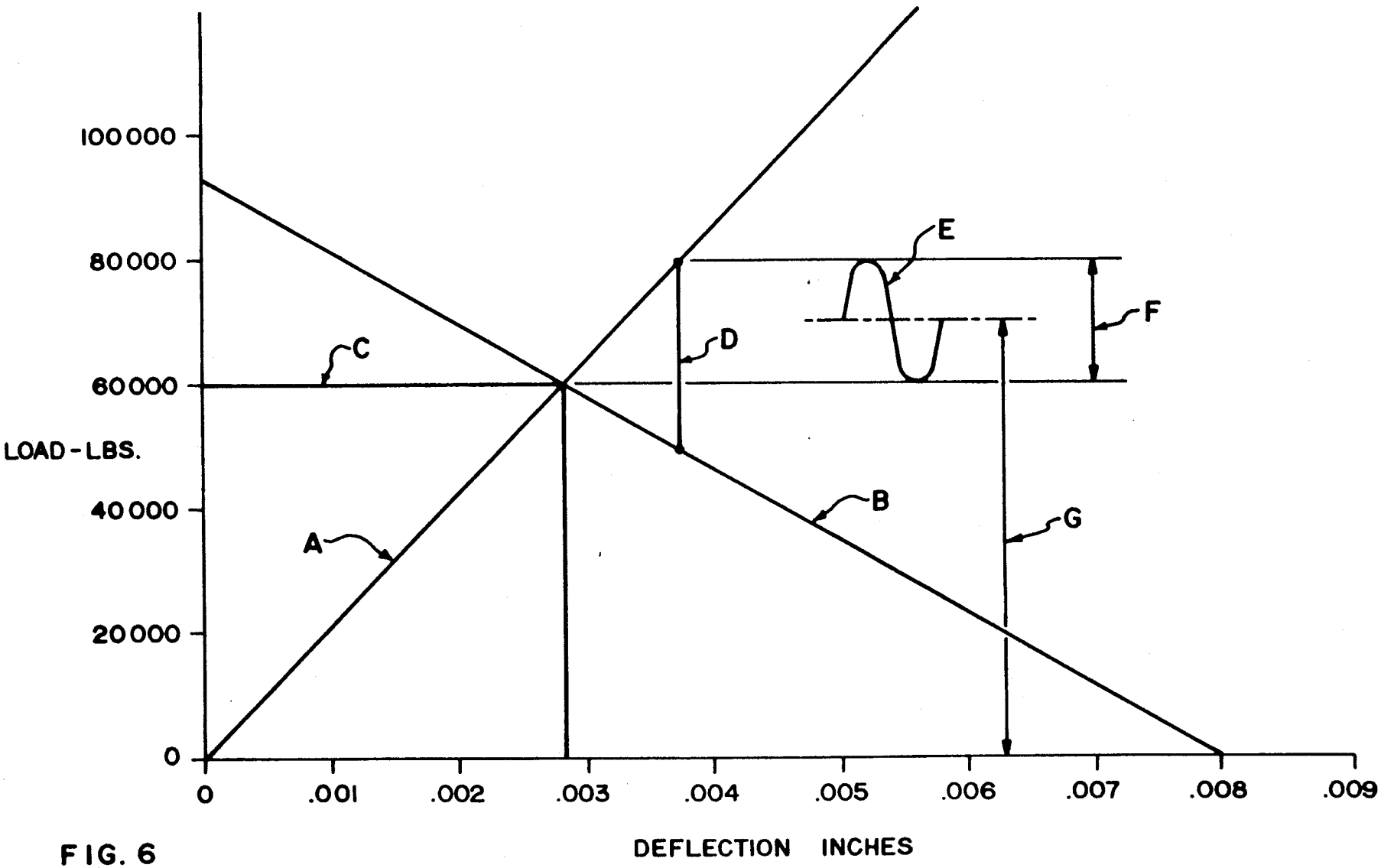

FIG. 6 is a joint deflection diagram for a bearing apparatus according to an embodiment of the invention. The load on the members in pounds is plotted against their deflection. Curve A indicates the deflection of the tension member, while curve B indicates the deflection of the compression members. Curve C represents a preload of 60,000 lb. applied to the tension member. Line D represents the maximum 35,000 lb cyclic force exerted by the vibrator. The cyclic load on the tension member is indicated by curve E. The maximum magnitude of this load, indicated at F, is 18,500 lbs. It may be observed that the effect of preloading is to reduce considerably the magnitude of the cyclic load in the tension member compared with the maximum variable force of 35,000 pounds exerted by the vibrator and to eliminate free play in the bearings. The average tensile load on the inner member as indicated at G is 70,000 lbs.

Referring to FIG. 2 and 3, compressive loads are exerted on the drill string and the drill bit when the eccentric members 20.1 and 22.1 have moved towards the bottom of their travel. These loads are transferred from the top of the inner member via shoulder 59 to the inner races of the set of bearing 38.1 and directly through their balls 80 to the outer member 24.1 and then to the drill string. Therefore, compressive loads do not affect the load on threads 87 of the nut shown in FIG. 3.

Tensile loads occur as the eccentric members reach the top of their movement. The effect is to stretch the inner member as nut 60 is pulled upwardly against the inner bearings of the bottom set of bearings and, simultaneously, reducing the compressional load in the spacer, but not enough to give rise to free play in the bearing.

Figure 4:
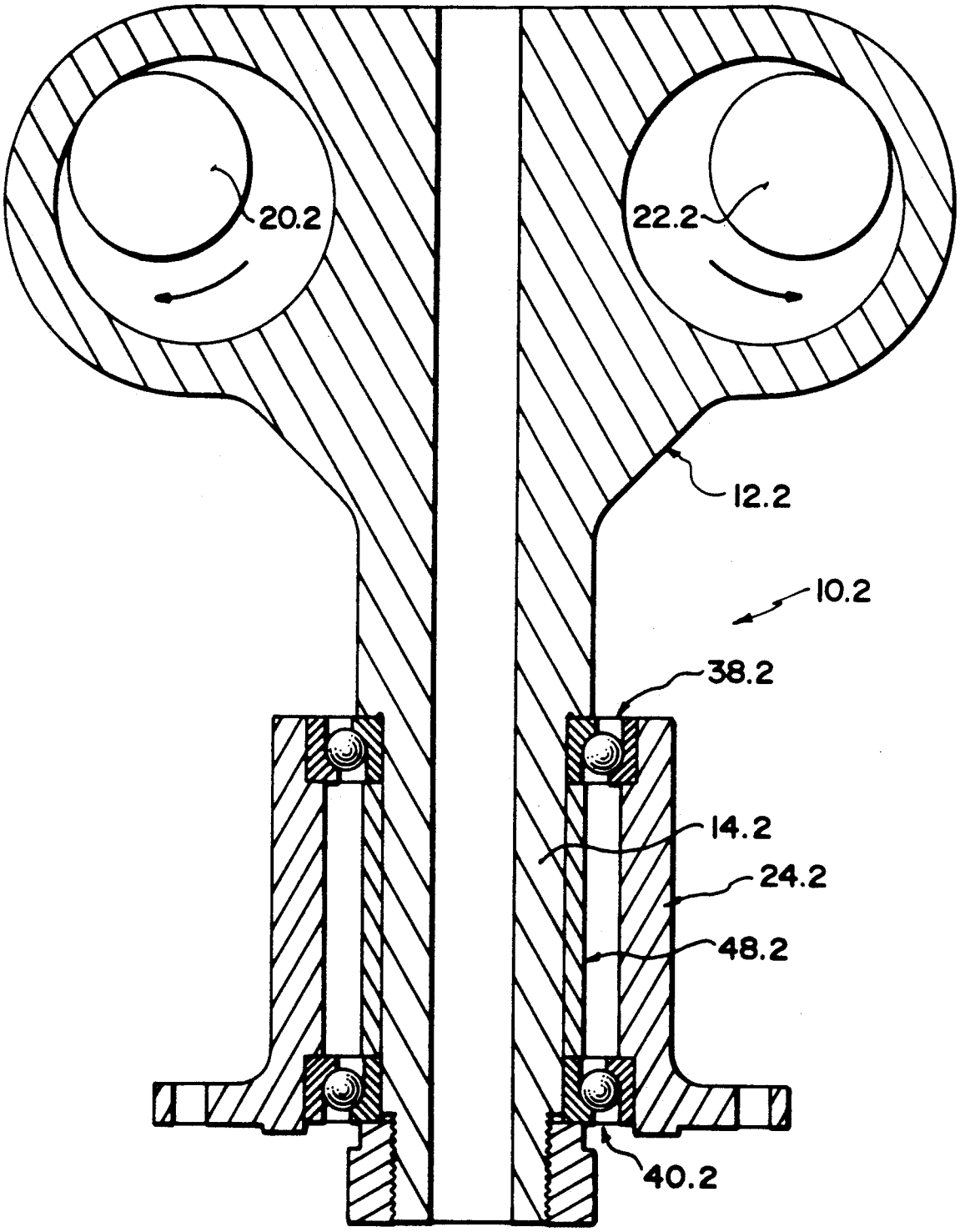
FIG. 4 is a simplified, sectional elevation of a bearing assembly and vibrator according to a third embodiment of the invention.
Figure 5:
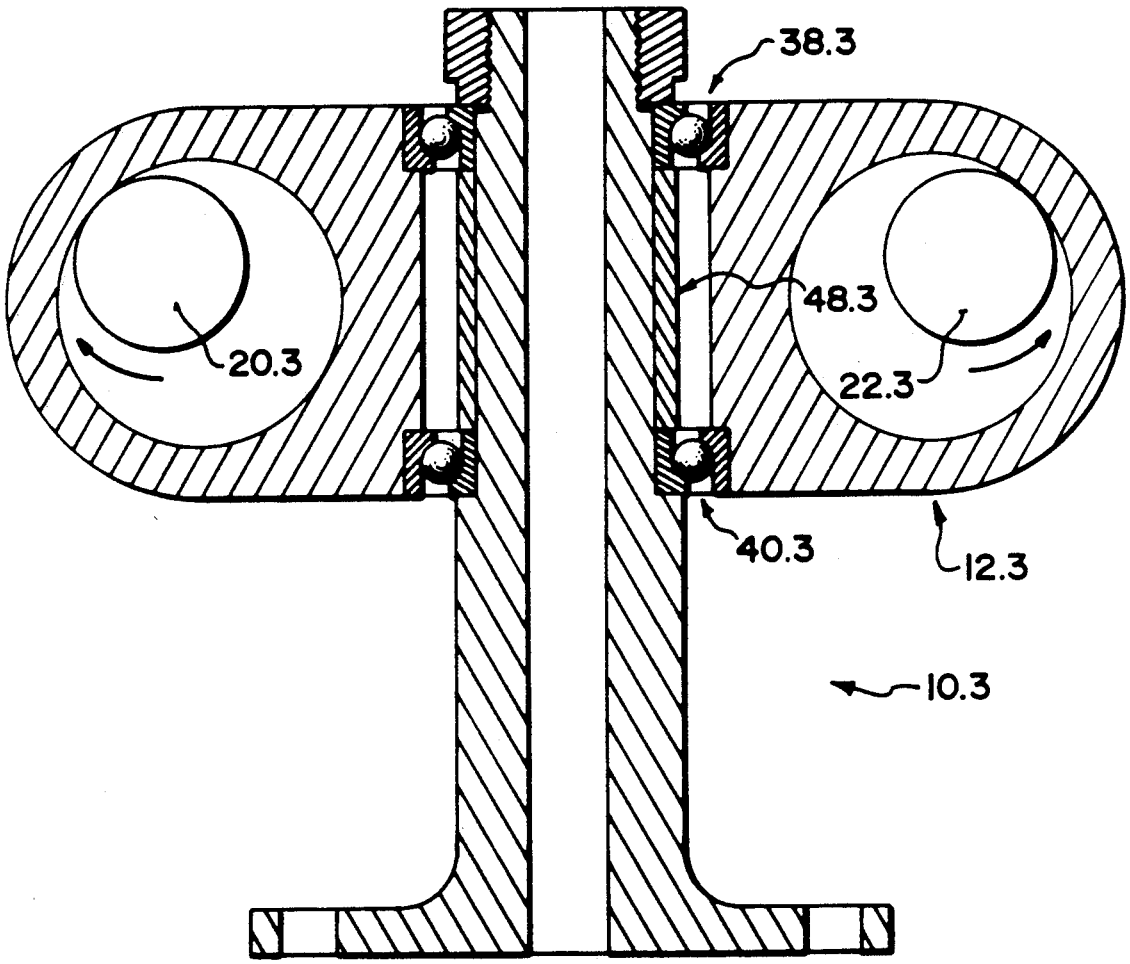
FIG. 5 is a view similar to FIG. 4 of a fourth embodiment of the invention; and, FIG. 6 is a joint deflection diagram for a bearing assembly for combination rotary and vibratory drills according to the invention.

FIGS. 4 and 5 show alternative embodiments of the invention which are generally the same as those described, but the inner member and outer member respectively are integral with the vibrator. In FIG. 4, the structure is generally the same as in FIG. 2, but like parts have like numbers with the additional designation "0.2" instead of "0.1". Here however, the sets of bearings 38.2 and 40.2 comprise only a single bearing each.

In FIG. 5, like parts have like numbers with the additional designation "0.3". The eccentrics 20.3 and 22.3 are on opposite sides of bearing sets 38.3 and 40.3 which comprise a single bearing each.

What is claimed is:

1. A combination rotary and vibratory assembly, comprising;

an annular outer member having a central opening;

an inner member within the opening of the outer member;

a first bearing means and a second bearing means, the bearing means being spaced-apart and being between the outer member and the inner member for permitting relative rotation between the members about an axis, each of the bearing means having an inner race slidably mounted on the inner member and an outer race, a portion of the outer member being received between the outer races so as to hold the outer races apart, each of the bearing means having means for transmitting forces from the inner member to the outer member which are parallel to the axis and act in the direction towards the other said bearing means;

a spacer disposed between the inner races;

means operatively connected to the inner member for biasing the inner races towards each other along the axis to compress the spacer between the inner races and to compress the portion of the outer member between the outer races;

means operatively connected to a first said member for applying an oscillating force to said first member, said oscillating force oscillating between a maximum amount applied in a first direction along the axis and a maximum amount applied in a second direction along the axis, the second direction being opposite to the first direction; and means operatively connected to a second said member for rotating the second said member.

2. An assembly is claimed in claim 1, wherein the means for transmitting of each said bearing means transmits from the inner member to the outer member only those forces parallel to the axis which act in said direction towards the other said bearing means.

3. An assembly is claimed in claim 1, wherein the means for biasing biases the inner races towards each other with a first force, said first force having a first component which is transmitted from the inner member to the portion of the outer member by the bearing means and a second component borne by the spacer.

4. An assembly as claimed in claim 3, wherein the first component of the first force is less than the second component.

5. An assembly is claimed in claim 1, wherein, when uncompressed by said means for biasing, the spacer holds the inner races a first distance apart and the portion of the outer member holds the outer races a second distance apart.

6. An assembly as claimed in claim 1, wherein the means for biasing the inner races applies a force sufficient to eliminate radial and axial play in the bearing means during oscillation of the assembly along said axis.

7. An assembly as claimed in claim 5, wherein the spacer has, when uncompressed, a dimension extending between the inner races which is less than the second distance.

8. An assembly as claimed in claim 1, further including means operatively connected to a second said member for mounting a rotatable vibrating tool on said second member.

9. An assembly as claimed in claim 1, wherein the maximum amounts of the oscillating force are less than the second component of the first force.

10. An assembly as claimed in claim 1, wherein the spacer has a size and elastic modulus such that the second component of the first force borne by the spacer is greater than the maximum amount of the oscillating force applied to said first member.

11. An assembly as claimed in claim 1, wherein the spacer has a size and an elastic modulus such that a portion of the inner member between the inner races is always under tension, and the spacer is always under compression when the inner races are compressed towards each other by the means connected to the inner member and the oscillating force is applied by the means operatively connected to the first member.

12. An assembly as claimed in claim 1, wherein each of the bearings means comprises at least one angular contact ball bearing.

13. An assembly as claimed in claim 1, wherein the spacer comprises a sleeve extending slidably about the inner member.

14. An assembly as claimed in claim 13, wherein the means for biasing includes a portion of the inner member contacting a first of the inner races on a side of said first inner race which is opposite a second of the inner races, and a nut threadedly engaging the inner member and contacting a side of the second said inner race which is opposite the first inner race.

15. An assembly as claimed in claim 14, further including means operatively connected to a first said member for applying an oscillating force to said first member, said oscillating force oscillating between a maximum amount applied in a first direction along the axis and a maximum amount applied in a second direction along the axis, the second direction being opposite the first direction, and means operatively connected to a second said member for mounting a rotatable vibrating tool on said second member.

16. An assembly as claimed in claim 15, wherein the inner member has a top, the means for applying an oscillating force being connected to the top of the inner member, the outer member having a bottom, the means for mounting being connected to the bottom of the outer member.

17. An assembly as claimed in claim 13, wherein the means for applying an oscillating force is connected to the outer member, the inner member having a bottom, the means for mounting being connected to the bottom of the inner member.

18. An assembly as claimed in claim 1, wherein the means for biasing applies a force to the spacer sufficient to maintain the spacer in compression during application of said oscillating force.

* * * * *